US006619516B2

(12) United States Patent
Weiler et al.

(10) Patent No.: US 6,619,516 B2
(45) Date of Patent: Sep. 16, 2003

(54) HERMETICALLY SEALED CONTAINER WITH UNITARY DROP-DISPENSER

(75) Inventors: Gerhard H. Weiler, Woodstock, IL (US); Valentin Cosman, Barrington Hills, IL (US)

(73) Assignee: Weiler Engineering, Inc., Elgin, IL (US)

( * ) Notice: Subject to any disclaimer, the term of this patent is extended or adjusted under 35 U.S.C. 154(b) by 4 days.

(21) Appl. No.: 10/071,944

(22) Filed: Feb. 5, 2002

(65) Prior Publication Data

US 2003/0146245 A1 Aug. 7, 2003

(51) Int. Cl.[7] ..... B65D 47/18
(52) U.S. Cl. ..... 222/420; 222/541.9
(58) Field of Search ..... 222/420, 541.9

(56) References Cited

U.S. PATENT DOCUMENTS 4,671,763 A * 6/1987 Weiler ..... 425/525
4,787,536 A * 11/1988 Widerstrom ..... 222/541.9
4,871,091 A * 10/1989 Preziosi ..... 222/420

* cited by examiner

*Primary Examiner*—Philippe Derakshani
(74) *Attorney, Agent, or Firm*—Olson & Hierl, Ltd.

(57) ABSTRACT

A hermetically sealed container has a closure connected to the container by a frangible web and is provided with a unitary drop dispenser suitable for dropwise dispensing of a liquid contained therein. A hollow container body defines a liquid enclosure and has a dispensing nozzle that is unitary with the container body at a proximal end thereof. A hollow, campanulate chamber is situated at the distal end of the nozzle. The dispensing nozzle defines a liquid flow passageway in communication with the liquid enclosure and with the companulate chamber, and has a substantially uniform inside diameter. The hollow, campanulate chamber has a maximum inside diameter that is larger than the inside diameter of the liquid flow passageway and defines a drop dispensing aperture having an inside diameter that is smaller than the inside diameter of the liquid flow passageway. The drop dispensing aperture is defined by an annular flange that is connected to a closure cap at a frangible web. The drop dispensing aperture is exposed for dropwise dispensing of the contents of the container when the frangible web is fractured and the closure cap is removed.

8 Claims, 3 Drawing Sheets

HERMETICALLY SEALED CONTAINER WITH UNITARY DROP-DISPENSER

TECHNICAL FIELD OF THE INVENTION

This invention relates to an hermetically sealed container having a closure connected to the container by a frangible web and, more particularly, to such a container provided with a unitary drop-dispenser.

BACKGROUND OF THE INVENTION

Hermetically sealed containers with unitary closures are known. Such containers typically have a body portion, a top or neck portion, and a closure portion to close and seal the opening in the neck portion. It is also known to provide such containers with means for permitting the containers to be unsealed and opened by breaking off the closure portion at the top of the container.

To facilitate the opening of such a container, a frangible web is typically provided between the container neck portion and the closure portion. The frangible web comprises a reduced thickness region in the wall of the material forming the container. Such a container can be opened by twisting or bending a part of the container on one side of the frangible web so as to rupture or sever the reduced thickness region of material at the frangible web.

Containers incorporating the above-described frangible web structure are usually formed from a thermoplastic molding material such as polyethylene (low or high density), polypropylene, or like materials compatible with the contents of the container. Such containers are conventionally fabricated by blow molding or vacuum forming in split mold parts that close along a parting plane.

The frangible web can be formed by conventional techniques during the container molding processes. Of course, before the top closure is molded, the container is filled with the desired contents from a filling tube. A typical formed, filled and sealed container of this type is disclosed in U.S. Pat. No. 4,671,763 to Weiler et al. This patent also discloses the fabrication process as well as the apparatus therefor.

The above-described hermetically sealed, thermoplastic containers are used to package a variety of materials. Such containers have been found to be especially suitable for use in dispensing sterile fluids, such as pharmaceutical solutions and ointments. While these conventional containers function satisfactorily for the purposes for which they have been designed, it would be desirable if the advantages offered by such hermetically sealed containers could be employed in other applications. Specifically, it would be beneficial to be able to use such a container for dispensing drops of fluid of uniformly repeatable size. This would assure the consistent dispensing of a measured quantity of a pharmaceutical solution, for example.

However, the use of such containers for dispensing drops has not been altogether satisfactory. When the closure is removed from the container by tearing or twisting the closure along the connecting frangible web, the exposed dispensing orifice or aperture on the container may be surrounded by a relatively rough, uneven, or jagged region which defines the surface at the broken frangible web. Such uneven orifices may interfere with the formation of uniformly repeatable drops from a given container, and may contribute to a variation in drop size from one container to another depending on the vagaries of the broken frangible web. Furthermore, the geometry of the neck of the container adjacent the drop-dispensing orifice or aperture may not be conducive to the formation of stable, controllable drops of predictable and repeatable size.

It would be desirable to provide an improved hermetically sealed container with the convenience of a twist-off closure that also includes a unitary drop-dispenser for reliable and repeatable dispensing of drops of predictable size.

The present invention provides the aforementioned desirable benefits and features.

SUMMARY OF THE INVENTION

The present invention provides an hermetically sealed container having a closure connected to the container by a frangible web and is provided with a unitary drop dispenser.

A unitary, hermetically sealed container of a thermoplastic material, suitable for dropwise dispensing of a liquid contained therein, includes a hollow container body defining a liquid enclosure and provided with a dispensing nozzle unitary therewith at a proximal end. A hollow, campanulate chamber is provided at the distal end of the nozzle. The dispensing nozzle defines a liquid flow passageway in communication with the liquid enclosure and with the chamber, and has a substantially uniform inside diameter. The hollow, campanulate chamber has a maximum inside diameter that is larger than the inside diameter of the liquid flow passageway and defines a drop dispensing aperture having an inside diameter that is smaller than the inside diameter of the liquid flow passageway.

The drop dispensing aperture is defined by an annular flange connected to a closure cap at a frangible web that surrounds the dispensing aperture. The drop dispensing aperture is exposed for dropwise dispensing of the contents of container by fracturing the frangible web and removing the closure cap.

There are other advantages and features of the present invention which will be more readily apparent from the following detailed description of the preferred embodiment of the invention, the accompanying drawings, and the appended claims.

DESCRIPTION OF THE PREFERRED EMBODIMENT

Figure 1:
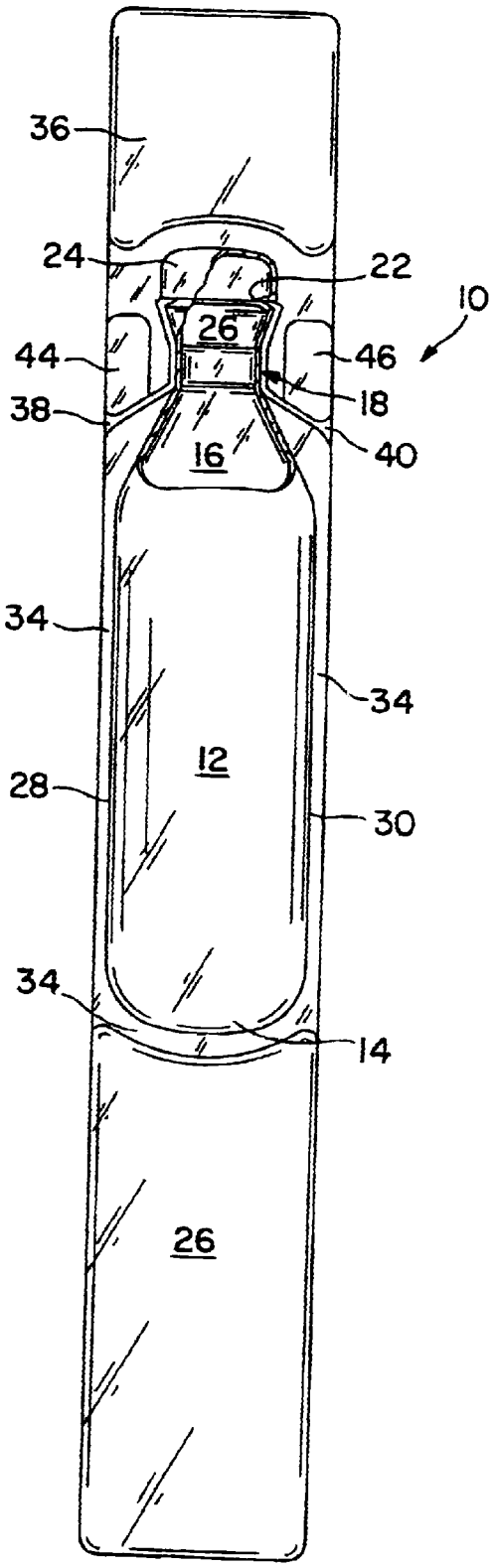
FIG. 1 is a front elevational view of the molded container of the present invention, partially cut away.
Figure 3:
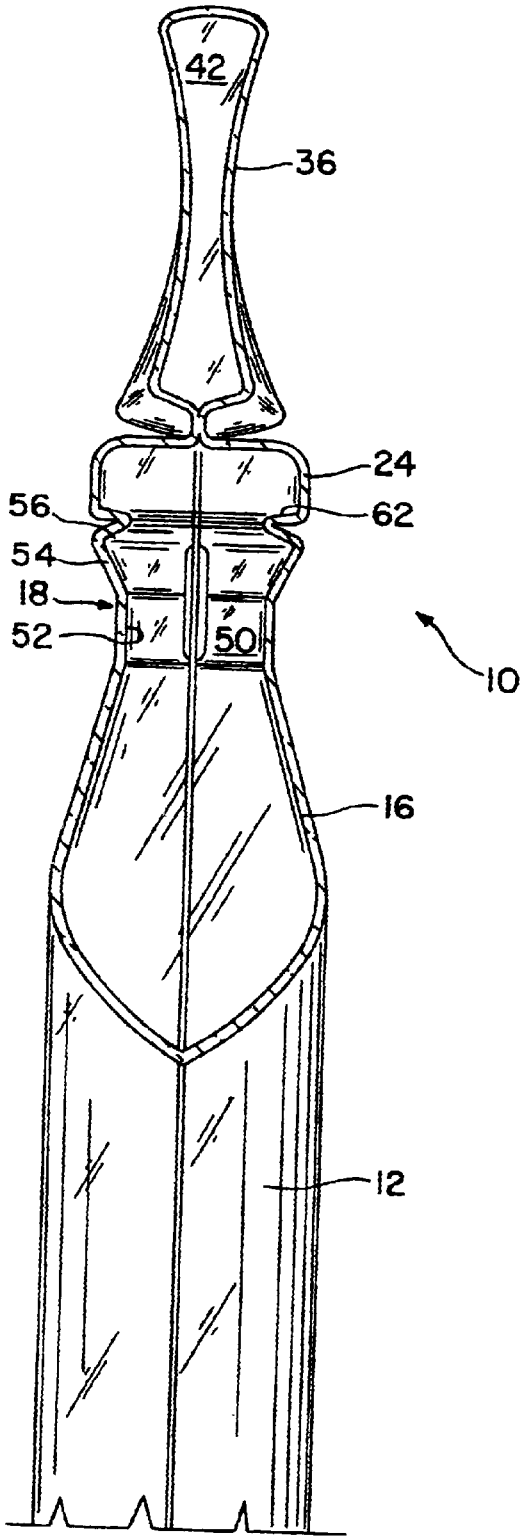
FIG. 3 is an enlarged side elevational view of a region of the container of FIG. 1, partially cut away to show interior detail.
Figure 2:
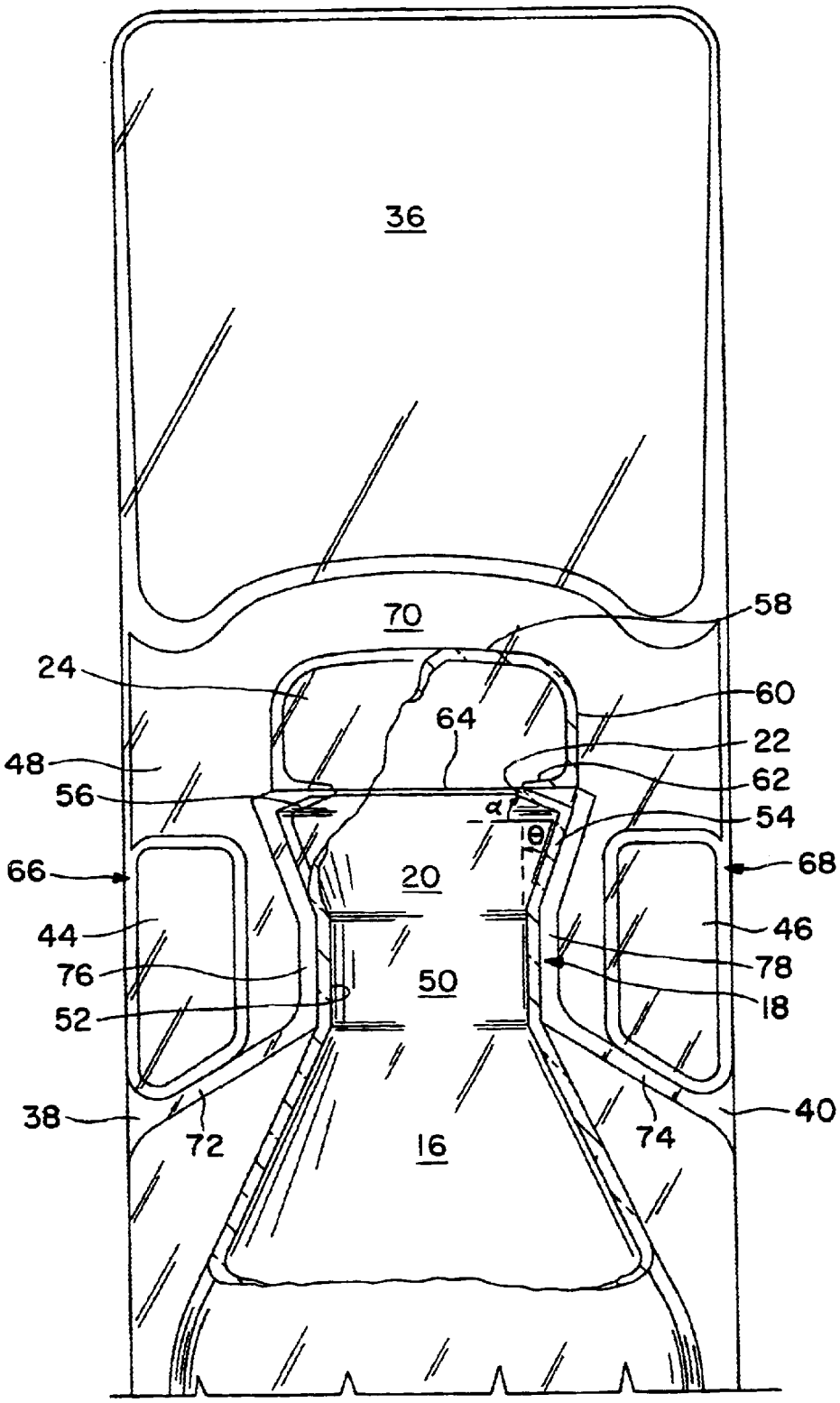
FIG. 2 is an enlarged front elevational view of a region of the container of FIG. 1, partially cut away to show interior detail.
Figure 4:
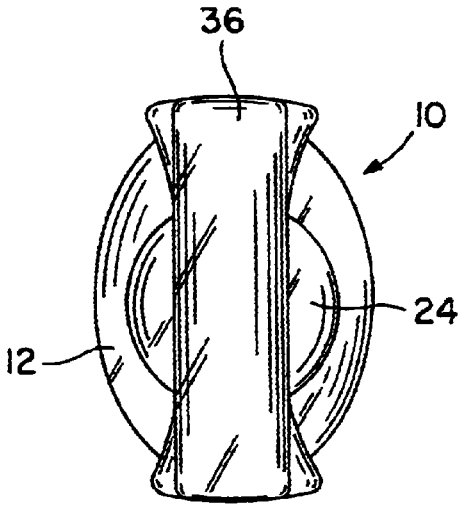
FIG. 4 is a top plan view of the container of FIG. 1.

The invention disclosed herein is, of course, susceptible of embodiment in many different forms. Shown in the drawings and described below in detail is a preferred embodiment of the invention. It is to be understood, however, that the present disclosure is an exemplification of the principles of the invention and does not limit the invention to the illustrated embodiment.

The precise shapes and sizes of the components described herein are not necessarily essential to the invention, since the invention is described with reference to an illustrative embodiment only.

For ease of description, the container of the invention will be described in a normal (upright) operating position and terms such as upper, lower, horizontal, etc., will be used with reference to this position. It will be understood, however, that the container may be manufactured, stored, transported, used, and sold in an orientation other than the position described.

The container of this invention may be fabricated and assembled with conventional molding apparatus and other mechanisms, the details of which, although not fully illustrated or described, will be apparent to those having skill in the art and an understanding of the necessary functions of such apparatus and mechanisms. The detailed descriptions of such apparatus or other mechanisms are not necessary to an understanding of the invention and are not herein presented because such apparatus and other mechanisms form no part of the present invention.

The present invention permits a variety of thermoplastic materials, preferably low or high density polyethylene, polypropylene, and the like, to be molded with a split molding process to provide a hermetically sealed dispensing container with a unitary drop dispenser that can be opened by rupturing a frangible web around a drop dispensing aperture or orifice and used to dispense uniformly repeatable drops of medication and the like.

Figure 5:
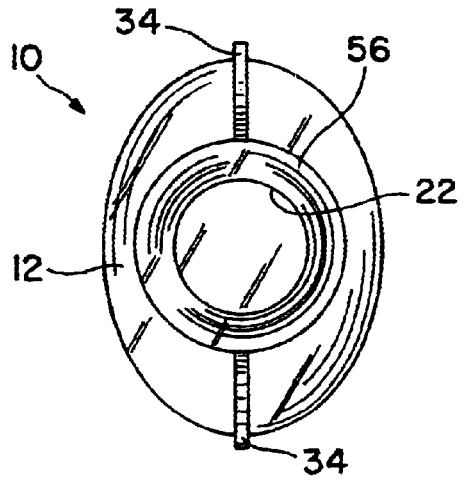
FIG. 5 is top plan view of the container of FIG. 1 with the closure portion removed.
Figure 6:
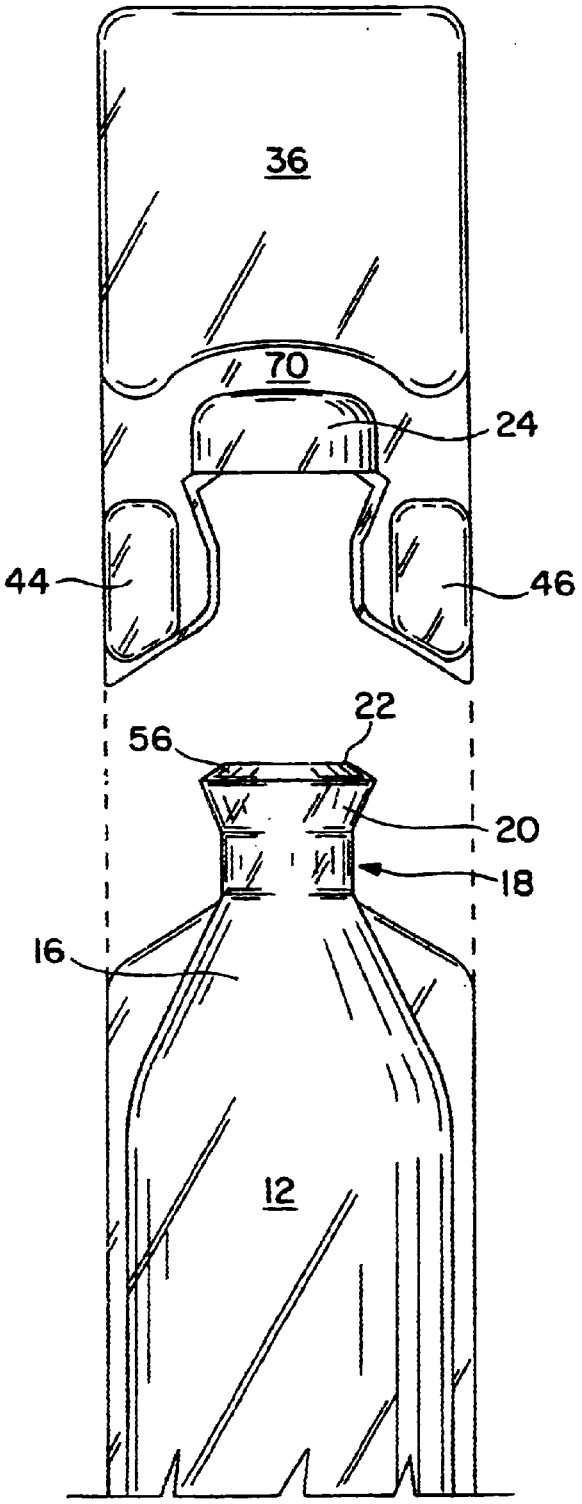
FIG. 6 is an enlarged and exploded front elevational view of the closure portion removed from the container body portion of the container of FIG. 1.

A thermoplastic container embodying the present invention is initially molded and filled as a unitary, hermetically sealed structure generally utilizing, for example, the technique and apparatus described U.S. Pat. No. 4,671,763 to Weiler et al. A formed and hermetically sealed container 10 of the present invention is illustrated in FIGS. 1–4. The unsealed, opened container 10 is shown in FIGS. 5–6. The container 10 is preferably fabricated from conventional thermoplastic molding materials such as polyethylene (low or high density), polypropylene, and the like materials compatible with the container contents. Preferably, container 10 is formed by blow molding or vacuum forming an extruded parison within a hollow mold.

The teachings of the present invention find application in the production of filled and unfilled containers having a wide variety of shapes and sizes. Referring to FIG. 1, Container 10 is an example of one such container and includes a hollow container body 12 having a bottom wall 14 and a top neck portion 16 having a nozzle 18 that opens to a companulate chamber 20 that terminates at a drop dispensing aperture 22. A cap 24 closes and seals drop dispensing aperture 22. Inner surfaces of companulate chamber 20 and nozzle 18 define an open, axial passageway in communication with hollow top neck portion 16 of hollow container body 12 of container 10.

Integral and unitary with container body 12 is a lower grip tab 26 that extends below bottom wall 14 and along the opposite sides 28 and 30 of container body 12. Grip tab 26 is hollow and is connected by a solid web or flange 34 immediately adjacent container body 12.

An upper grip tab 36 is integral and unitary with cap 24 and is joined to lower grip tab 26 at frangible webs 38 and 40. Upper grip tab 36 has a hollow gripping portion 42 above cap 24 (FIGS. 2 &3) and a pair of hollow gripping aids 44 and 46 disposed laterally of nozzle 18 and companulate chamber 20. The remainder of upper grip tab 36 is a solid web or flange 48 immediately adjacent frangible webs 38 and 40, and cap 24. Frangible webs 38 and 40 are of lesser thickness than web or flange 48 so that upper grip tab 36 can be separated from lower grip tab 26 and container body 12 by fracture of frangible webs 38 and 40. Preferably, container body 12, cap 24, lower grip tab 26, upper grip tab 36 and frangible webs 38 and 40 are integral and unitary, formed by blow molding and/or vacuum forming of an extruded parison within a hollow, multi-part mold.

The top neck portion 16 of container body 12 tapers to a nozzle 18 unitary therewith which includes a generally cylindrical throat 50 defining a liquid flow passageway 52 of substantially uniform inside diameter for dispensing container contents. Throat 50 terminates in companulate chamber 20 defined by an upwardly diverging frusto-conical wall 54 followed by an upwardly converging, peripheral, inwardly extending, unitary frusto-conical annular flange 56. Preferably, frusto-conical wall 54 and annular flange 56 join at about a right angle of about 89 to about 91 degrees, and more preferably at about 90 degrees. Frusto-conical wall 54 preferably diverges upwardly at an acute angle "$\theta$" of about 20 degrees relative to a vertical axis. Frusto-conical flange 56 preferably converges upwardly at an acute angle "$\alpha$" of about 20 degrees relative to horizontal, or at about 70 degrees relative to a vertical axis. Frusto-conical flange 56 terminates at circular drop-dispensing aperture 22.

The inside diameter of the drop dispensing aperture 22 is preferably about 5 to 10 percent less, and more preferably about 7 percent less, than the diameter of the liquid flow passageway 52. The ratio of the maximum inside diameter of companulate chamber 20 to the inside diameter of the liquid flow passageway 50 is preferably in the range of about 1.2 to about 1.35.

Cap 24 includes an upper end wall 58 making a rounded transition to a substantially cylindrical side wall 60. From the lower edge of side wall 60, an annular flange 62 extends radially inwardly from side wall 60. Annular flange 62 merges with frusto-conical flange 56 at drop dispensing aperture 22. Each of annular flange 62 and frusto-conical flange 56 are tapered to a reduced thickness in the direction toward drop-dispensing aperture 22 so that flange 62 and flange 56 meet at a frangible web 64. Preferably, frangible web 64 has a thickness of about 0.0005 inches.

Container 10 is initially a unitary piece. Upper grip tab 36, including gripping aids 44 and 46, and cap 24 can be readily removed from container body 12, including nozzle 18 and companulate chamber 20, and lower grip tab 26, upon fracture of frangible webs 38, 40 and 64. Frangible web 64 removably connects cap 24 to container body 12. Such fracture also exposes the drop dispensing aperture 22 so that container body 12 can be inverted and drops of liquid can be dispensed therefrom. (FIGS. 5 and 6)

Grip tab 36 is in the shape of an inverted "U" and surrounds the cap 24. Tab 36 includes two spaced apart wings 66 and 68, and a bridge 70 therebetween. Bridge 70 is unitary with and extends generally longitudinally above the top of cap 24. Wings 66 and 68 are unitary with opposite ends of the bridge 70 and extend generally vertically downwardly therefrom. Wings 66 and 68 terminate at an inclined web portion 72 and 74, respectively, of frangible webs 38 and 40. Each of the wings 66 and 68 also terminates at a longitudinal web portion 76 and 78, respectively, of frangible webs 38 and 40 that is positioned generally adjacent and parallel to the dispensing nozzle 18 and companulate chamber 20. Hollow gripping aids 44 and 46 serve to stiffen wings 66 and 68 and also serve to provide a further gripping surface for exerting twisting force on grip tab 36.

To dispense container contents, cap 24 is severed and removed from the container body 12 by grasping lower grip tab 26 in one hand and grasping gripping aids 44 and 46 of wings 66 and 68 and upper grip tab 36 in the other hand and then exerting a simultaneous twisting and lifting motion to grip tab 36 so as to break frangible webs 38, 40 and 64. Once the cap 24, which is initially integral with upper grip tab 36, has been removed (see FIGS. 5 and 6), container body 12 can be inverted to dispense the contents drop-wise from drop-dispensing aperture 22.

A container embodying the present invention such as container 10 can be molded by an apparatus and method similar to that illustrated and described in U.S. Pat. No. 4,671,763 to Weiler et al., which is hereby incorporated by reference. Such a method of forming a container is initiated at an extruder head of conventional design which is adapted to extrude a length of parison in the form of a elongated, hollow tube of a semi-molten thermoplastic material. A mold assembly is positioned in spaced relationship from and around the extruded parison. The mold assembly includes coacting mold halves separable along a vertical plane.

Typically, a card with more than one container 10 is fabricated at one time in a multi-cavity mold assembly. The mold assembly may include a plurality of coacting mold halves aligned in a row and a plurality of extruder heads may be provided in a row for extruding a length of parison between each of the coacting mold halves.

A parison is initially extruded and depends vertically downwardly between each of the coacting mold halves. The mold halves are then moved together by suitable means, such as a pneumatic, electric or hydraulic actuator. The mold halves cooperate when moved together to define a cavity. The parison is expanded to conform to the configuration of the mold cavity by application of compressed gas internally of the parison or by use of an external vacuum.

After the formed container body 12 has been filled with the desired amount of contents via a filling tube, the seal mold halves are moved to a sealing position wherein the mold halves cooperate together to define a cap cavity in communication with the container body cavity for forming and molding the sidewall and top wall of the cap 24.

The mold halves define an annular knife edge protruding generally radially inwardly. The annular knife edge forms the frangible web 64 that permits separation of cap 24 from container body 12. Other protrusions extending inwardly between the mold halves form the frangible webs 38 and 40 that divide upper grip tab 36 from container body 12 and lower grip tab 26.

After the container 10 has been molded and its contents thus sealed within the container body portion 12, the coacting mold halves are opened and the formed, filled and sealed container 10 may be removed and deflashed by suitable conventional means.

The foregoing description and the drawings are intended as illustrative and are not to be taken as limiting. Still other variants and arrangements of parts are possible without departing from the spirit and scope of the present invention and will readily present themselves to those skilled in the art.

We claim:

1. A unitary, hermetically sealed container of a thermoplastic material, suitable for dropwise dispensing of a liquid contained therein, and comprising:

a hollow container body defining a liquid enclosure and provided with a dispensing nozzle unitary with the container body at a proximal end and having a distal end; and a hollow, campanulate chamber at the distal end of the nozzle;

said dispensing nozzle defining a liquid flow passageway in communication with the liquid enclosure and with said chamber, and having a substantially uniform inside diameter; and said hollow, campanulate chamber having a maximum inside diameter that is larger than the inside diameter of the liquid flow passageway and defining a drop dispensing aperture having an inside diameter that is smaller than the inside diameter of the liquid flow passageway.

2. The unitary, hermetically sealed container in accordance with claim 1 wherein the inside diameter of the drop dispensing aperture is about 5 to about 10 percent less than the inside diameter of the liquid flow passageway.

3. The unitary, hermetically sealed container in accordance with claim 1 wherein the inside diameter of the drop dispensing aperture is about 7 percent less than the inside diameter of the liquid flow passageway.

4. The unitary, hermetically sealed container in accordance with claim 1 wherein the drop dispensing aperture is defined by a peripheral, inwardly extending, unitary flange on the campanulate chamber, and wherein the flange extends away from an adjacent wall portion of the campanulate chamber at about a right angle.

5. The unitary, hermetically sealed container in accordance with claim 4, wherein the unitary flange is frusto-conical and converges toward the drop dispensing aperture at an angle of about 70 degrees relative a longitudinal axis of the container body.

6. The unitary, hermetically sealed container in accordance with claim 4, wherein the companulate chamber is defined at least in part by a frusto-conical wall diverging in a direction toward the drop dispensing aperture.

7. The unitary, hermetically sealed container in accordance with claim 6, wherein the frusto-conical wall diverges at an angle of about 20 degrees relative to a longitudinal axis of the container body.

8. The unitary, hermetically sealed container in accordance with claim 1 wherein the ratio of the maximum inside diameter of the campanulate chamber to the inside diameter of the liquid flow passageway is in the range of about 1.2 to about 1.35.

* * * * *